US006764112B2

(12) United States Patent
Lan-Shi et al.

(10) Patent No.: US 6,764,112 B2
(45) Date of Patent: Jul. 20, 2004

(54) AUXILIARY LOCK WITH AN ADJUSTABLE BACKSET

(75) Inventors: Huang Lan-Shi, Kaoshiung (TW); Juo-Chiao Wang, Kaohsiung Hsien (TW)

(73) Assignee: Taiwan Fu Hsing Industrial Co., Ltd. (TW)

( * ) Notice: Subject to any disclaimer, the term of this patent is extended or adjusted under 35 U.S.C. 154(b) by 0 days.

(21) Appl. No.: 10/189,456

(22) Filed: Jul. 8, 2002

(65) Prior Publication Data

US 2004/0004360 A1 Jan. 8, 2004

(51) Int. Cl.[7] ..... E05C 1/00
(52) U.S. Cl. ..... 292/1.5; 292/337
(58) Field of Search ..... 292/1.5, 337, 169; 70/134

(56) References Cited

U.S. PATENT DOCUMENTS 4,012,929 A * 3/1977 Solovieff ..... 70/134
4,372,594 A * 2/1983 Gater ..... 292/1.5
4,564,229 A * 1/1986 Mullich et al. ..... 292/1.5
4,593,542 A * 6/1986 Rotondi et al. ..... 70/134
4,639,025 A * 1/1987 Fann et al. ..... 292/337
4,662,665 A * 5/1987 Lin ..... 292/167
4,725,086 A * 2/1988 Shen ..... 292/1.5
4,752,090 A * 6/1988 Lin ..... 292/1.5
4,759,576 A * 7/1988 Ching ..... 292/1.5
4,768,817 A * 9/1988 Fann et al. ..... 292/1.5
4,950,008 A * 8/1990 Fang ..... 292/337
4,979,768 A * 12/1990 Marotto et al. ..... 292/337
5,364,138 A * 11/1994 Dietrich et al. ..... 292/1.5
5,456,503 A * 10/1995 Russell, IV ..... 292/1.5
5,489,128 A * 2/1996 Florian ..... 292/1.5
5,498,037 A * 3/1996 Fan Lai ..... 292/1.5
5,551,264 A * 9/1996 Fann et al. ..... 70/134
5,957,510 A * 9/1999 Kuo ..... 292/1.5
5,979,948 A * 11/1999 Aramburu ..... 292/1.5
6,148,650 A * 11/2000 Kibble ..... 70/134
6,318,769 B1 * 11/2001 Kang ..... 292/1.5

* cited by examiner

*Primary Examiner*—J. J. Swann
*Assistant Examiner*—Thomas Ho
(74) *Attorney, Agent, or Firm*—Bacon & Thomas, PLLC

(57) ABSTRACT

An auxiliary lock comprises a housing having a faceplate attached thereto. A casing includes a first end received in the housing and having two positioning slots for selectively engaging with a guide member of the housing. A deadbolt is received in the housing and slidable between a retracted position and an extended position. A connecting member is mounted to an end of the deadbolt. An end of a pull rod is mounted in the deadbolt and has two guide grooves each having a longitudinal section and two retaining sections transverse to the longitudinal section and communicated with the longitudinal section. When the connecting member is in the retaining sections, the deadbolt is not movable along the longitudinal direction of the housing. When the connecting member is in the longitudinal section, the deadbolt is movable along the longitudinal direction of the housing relative to the pull rod.

13 Claims, 7 Drawing Sheets

AUXILIARY LOCK WITH AN ADJUSTABLE BACKSET

BACKGROUND OF THE INVENTION

1. Field of the Invention

The present invention relates to an auxiliary lock with an adjustable backset. In particular, the present invention relates to a backset-adjustable auxiliary lock that has a simple structure and improved strength.

2. Description of the Related Art

FIG. 10 of the drawings illustrates a conventional auxiliary lock with an adjustable backset. A beveled face 82 on a pushbutton 81 abuts against an underside 84 of an adjusting plate 83 that has a shoulder 85 selectively engaged in one of two notches 87 and 88 of a push plate 86. When adjustment of the backset is required, the pushbutton 81 is pushed to disengage the shoulder 85 of the adjusting plate 83 from, e.g., the notch 87 of the push plate 86 and then engage with the other notch 88 of the push plate 86.

FIG. 11 illustrates another conventional auxiliary lock with an adjustable backset. The auxiliary lock comprises a housing 93 and a casing 92 mounted in the housing 93. The casing 92 and the housing 93 are rotatable relative to each other such that a hook 911 on the housing 93 is releasably engaged in a notch 921 in the casing 92. An L-shaped slot 922 is defined in a periphery of the casing 92, and a key 931 is formed on an outer periphery of the housing 93 and received in the slot 922. The key 931 is slidable along the slot 922 and thus causes a peg 941 on a plate 94 to selectively be engaged in one of two holes 952 and 953 on an extension 951 extending from an end of a deadbolt 95, allowing adjustment of the backset.

However, these conventional auxiliary locks have complicated structures due to numerous parts and thus causes troublesome manufacture. Further, adjustment of the backset is not easy. Further, these conventional auxiliary locks are apt to be destroyed due to insufficient strength.

SUMMARY OF THE INVENTION

It is a primary object of the present invention to provide a backset-adjustable auxiliary lock that has a simple, reinforced structure for easy manufacture.

An auxiliary lock in accordance with the present invention comprises:

a housing including a circular hole therein, a faceplate being attached to an end of the housing and including an opening, the housing further including a guide member;

a casing including a first end and a second end, the first end of the casing being received in the housing and including a first positioning slot and a second positioning slot, the second end of the casing including aligned pivot holes, the guide member being selectively engaged in one of the first positioning slot and the second positioning slot, wherein the housing is movable along a longitudinal direction of the housing when the guide member is disengaged from the first and second positioning slots of the casing, and wherein the housing is not movable along the longitudinal direction of the housing when the guide member is engaged in one of the first positioning slot and the second positioning slot;

a deadbolt assembly including a deadbolt, a connecting member, and a pull rod, the deadbolt being received in the housing and slidable between a retracted position in the housing and an extended position in which an end of the deadbolt is beyond the housing, the connecting member being mounted to another end of the deadbolt, the pull rod including a first end mounted in the deadbolt and a second end beyond the deadbolt, the first end of the pull rod including two guide grooves each having a longitudinal section and two retaining sections transverse to the longitudinal section and communicated with the longitudinal section, wherein when the connecting member is in the retaining sections, the deadbolt is not movable along the longitudinal direction of the housing, and wherein when the connecting member is in the longitudinal section, the deadbolt is movable along the longitudinal direction of the housing relative to the pull rod, the deadbolt and the opening of the faceplate being so configured that the deadbolt turns together with the housing when the deadbolt is in its extended position and that the deadbolt is not turnable when the deadbolt is in its retracted position; and a drive wheel including a cylindrical portion that is rotatably held in the pivot holes of the casing, a drive arm extending from the cylindrical portion and having an end connected to the second end of the pull rod such that rotation of the drive wheel causes movement of the pull rod for moving the deadbolt along the longitudinal direction of the housing.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENT

A preferred embodiment in accordance with the present invention will now be described with reference to the accompanying drawings.

Figure 1:
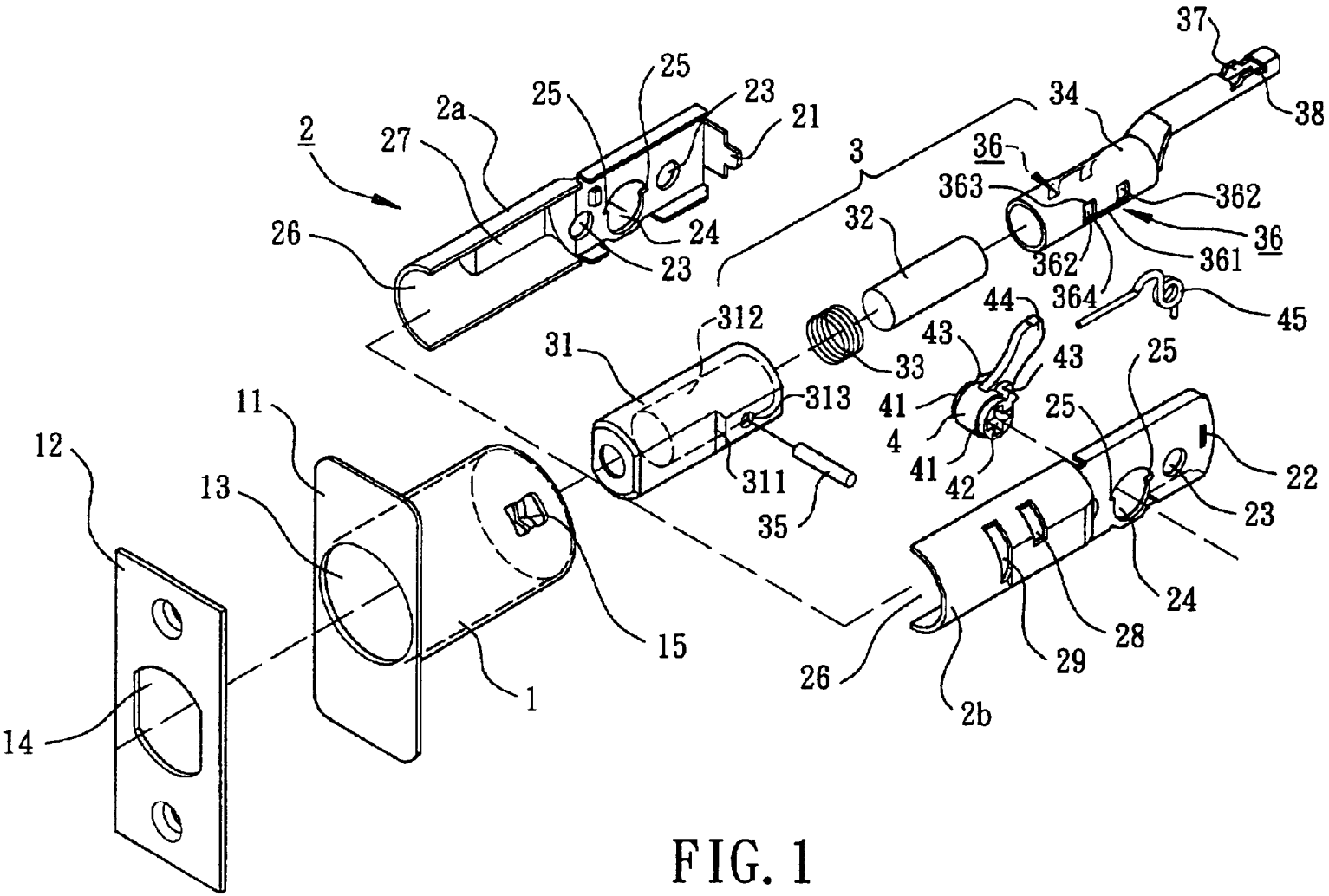
FIG. 1 is an exploded perspective view of an auxiliary lock with an adjustable backset in accordance with the present invention.
Figure 2:
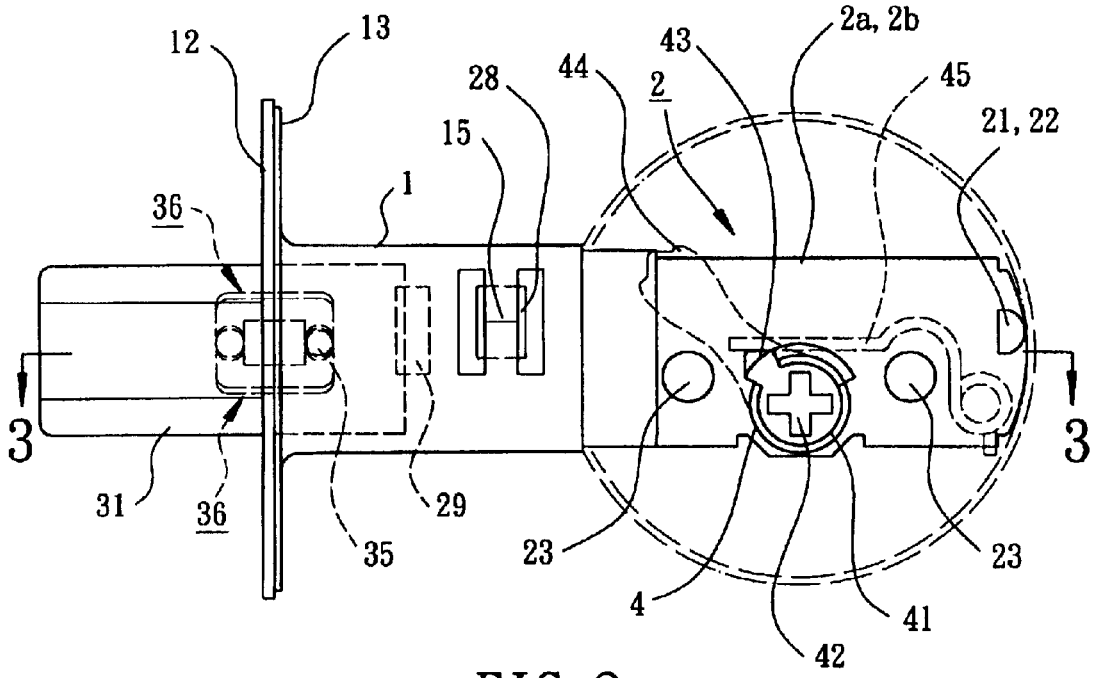
FIG. 2 is a sectional view of the auxiliary lock in accordance with the present invention.
Figure 3:
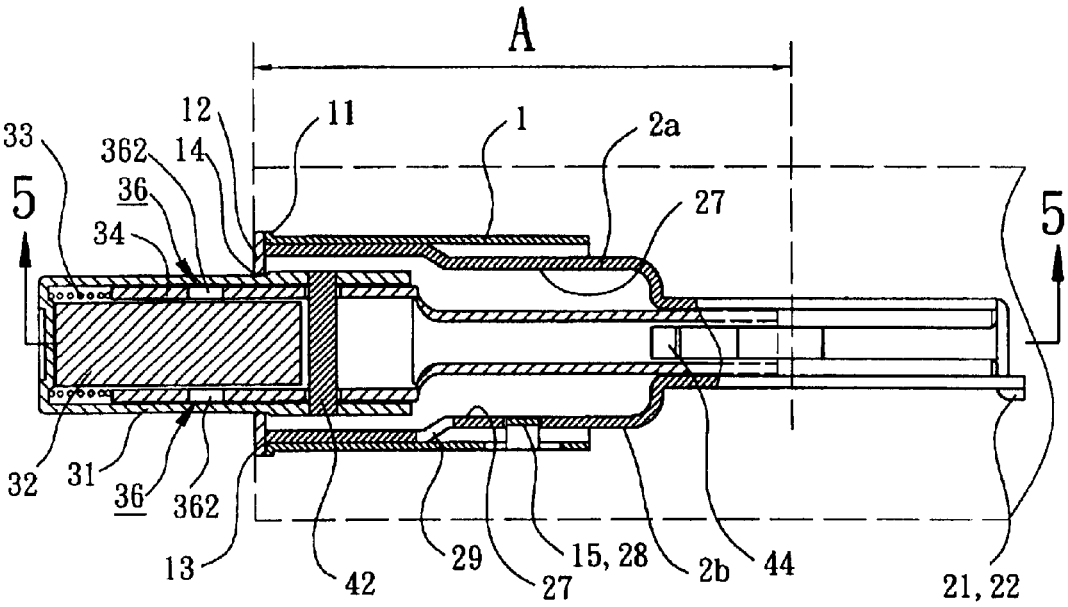
FIG. 3 is a sectional view taken along plane 3—3 in FIG. 2, wherein the deadbolt is in an extended position.

Referring to FIGS. 1 through 3, an auxiliary lock with an adjustable backset in accordance with the present invention generally includes a housing 1, a casing 2, a deadbolt assembly 3, and a drive wheel 4.

The housing 1 includes an end plate 11 on an end thereof to which a faceplate 12 is securely attached. The housing 1 includes a circular hole 13 for receiving a deadbolt 31 of the deadbolt assembly 3, and the faceplate 12 includes a non-circular opening 14 through which the deadbolt 31 extends for achieving the locking function. The deadbolt 31 includes a stop edge 311 on an outer periphery thereof for retraining movement of the deadbolt 31 along a longitudinal direction of the housing 1 and preventing disengagement of the deadbolt 31 from the housing 1. In order to provide a better positioning effect, the housing 1 includes a guide member 15 projecting inward into an interior of the housing 1. The guide member 15 may be formed by means of directly punching the housing 1. The hole 13 of the housing 1 allows insertion of the casing 2 and the deadbolt 3.

The casing 2 may be comprised of two casing halves 2*a* and 2*b* respectively having an engaging piece 21 and an engaging slot 22. The deadbolt assembly 3 is received in the casing 2 when in a retracted position shown in FIG. 4. Each casing half 2*a*, 2*b* includes two positioning holes 23 and a pivot hole 24. The positioning holes 23 allow passage of two mounting posts (not shown) of the auxiliary lock. The drive wheel 4 is pivotally received in the pivot holes 24. An inner periphery defining each pivot hole 24 includes two angularly spaced restraining edges 25 for restraining pivotal movement of the drive wheel 4. An end of the casing 2 is received in the housing 1 and rotatable relative to the housing 1. The end of the casing 2 includes a circular hole portion 26 and a non-circular hole portion 27. The non-circular hole portion 27 guides rectilinear movement of the deadbolt 31 relative to the casing 2, and the circular hole portion 26 allows rotational movement of the deadbolt 31 relative to the casing 2. In order to provide a better positioning effect after adjustment of the backset, at least one of the casing halves 2*a* and 2*b* (casing half 2*b* in this embodiment) has two positioning slots 28 and 29 in the non-circular hole portion 27 for selectively engaging with the guide member 15.

The deadbolt assembly 3 includes the deadbolt 31, a reinforcing member 32, an elastic element 33, and a pull rod 34. As mentioned above, the deadbolt 31 includes a stop edge 311 formed as a result of an enlarged section, best shown in FIG. 1. The enlarged section is wider than the opening 14 of the faceplate 14, and the remaining portion of the deadbolt 31 is passable through the opening 14 of the faceplate 14, thereby restraining longitudinal movement of the deadbolt 31. The deadbolt 31 includes a compartment 312 for receiving the reinforcing member 32 made of rigid material. An end of the pull rod 34 and the elastic element 33 are received in the compartment 312 of the deadbolt 31. The deadbolt 31 is connected by a connecting member 35 (e.g., in the form of a pin) to the pull rod 34. An end of the elastic element 33 is attached to an end wall defining the compartment 312 of the deadbolt 31, and the other end of the elastic element 33 is attached to an end face of the pull rod 34. After adjustment of the backset, the elastic element 33 returns the pull rod 34 to its initial position. Another function of the elastic element 33 is to bias the deadbolt 31 away from the faceplate 12, thereby preventing swaying or loosening of the deadbolt 31. If desired, the end of the pull rod 34 connected to the deadbolt 31 may be hollow for receiving an end of the reinforcing member 32. Two guide grooves 36 are symmetrically arranged on opposite sides of the pull rod 34. In this embodiment, one of the guide grooves 36 is U-shaped and other is inverted U-shaped. Each guide groove 36 includes a longitudinal section 361 allowing longitudinal movement of the connecting member 35 and two retaining sections 362 respectively formed on two ends of the longitudinal section 361 and communicated with the longitudinal section 361, the retaining sections 362 extending in a direction transverse to the longitudinal section 361 for restraining longitudinal movement of the connecting member 35. In this preferred embodiment, two ends of the connecting member 35 extend beyond the guide groove 36 and received in aligned transverse holes 313 of the deadbolt 31, best shown in FIG. 8. Thus, when the deadbolt 31 rotates relative to the pull rod 34, each end of the connecting member 35 moves between an inner end 363 of the associated retaining section 362 and an outer end 364 of the associated retaining section 362 that is coincident with an associated end of the longitudinal section 361. When the deadbolt 31 moves longitudinally relative to the pull rod 34, each end of the connecting member 35 slides along the associated guide groove 36. Thus, the position of the casing 2 and the pull rod 32 relative to the deadbolt 31 can be altered. The other end of the pull rod 34 includes a drive portion 37 having a hole 38 in which a drive arm 44 of the drive wheel 4 is engaged. Thus, when the drive wheel 4 is turned, the drive arm 44 moves the drive portion 37 longitudinally. As a result, the pull rod 34 moves longitudinally and thus causes retraction of the deadbolt 31.

The drive wheel 4 includes a cylindrical portion 41 having two ends respectively, rotatably received in the pivot holes 24 of the casing halves 2*a* and 2*b*. The cylindrical portion 41 includes an engaging hole 42 through which a spindle (not shown) of the auxiliary lock extends. The spindle is connected to a turn knob (not shown) mounted to an inner side of the door, which is conventional. Thus, when the turn knob (not shown) is turned, the spindle and the drive wheel 4 are turned, thereby retracting the deadbolt 31 into the housing 1 or extending the deadbolt 31 beyond the faceplate 12, depending on the turning direction of the turn knob. The drive arm 44 extends from a periphery of the cylindrical portion 41 and includes an end engaged in the hole 38 of the drive portion 37 of the pull rod 34. Thus, the pull rod 34 is moved when the drive wheel 4 is turned, as mentioned above. Further, the cylindrical portion 41 of the drive wheel 4 includes two stops 43 formed on the periphery thereof and located on both sides of the other end of the drive arm 44. In order to retaining the drive wheel 4 in place, an end of an elastic element 45 is attached to the drive wheel 4, and the other end of the elastic element 45 is fixed to the casing 2, as shown in FIG. 2. Thus, the drive wheel 4 may be retained in place after pivotal movement thereof.

The auxiliary lock shown in FIGS. 2 and 3 has a relatively smaller backset (i.e., the distance A between a center of the engaging hole 42 of the drive wheel 4 and the faceplate 12 is shorter) with the deadbolt 31 being in an extended state for locking purpose.

Figure 4:
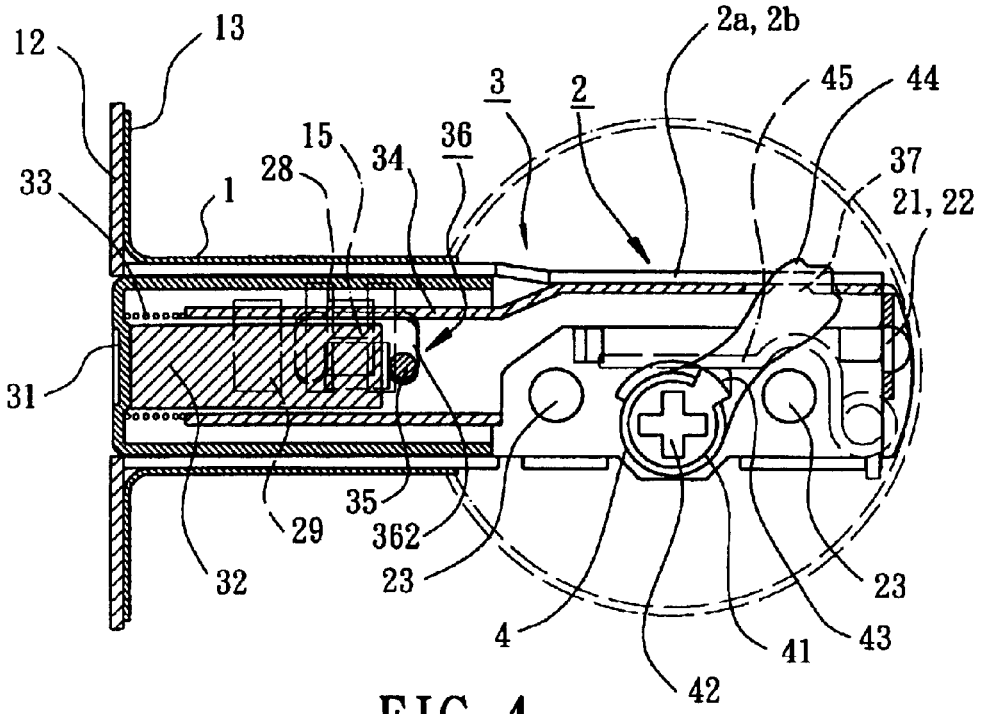
FIG. 4 is a sectional view similar to FIG. 3, wherein the deadbolt is in a retracted position.

When the drive wheel 4 is turned as a result of turning the turn knob in an unlocking direction, the pull rod 34 is moved inward, thereby retracting the deadbolt 31 into the housing 1. The auxiliary lock is thus unlocked, as shown in FIG. 4.

Figure 5:
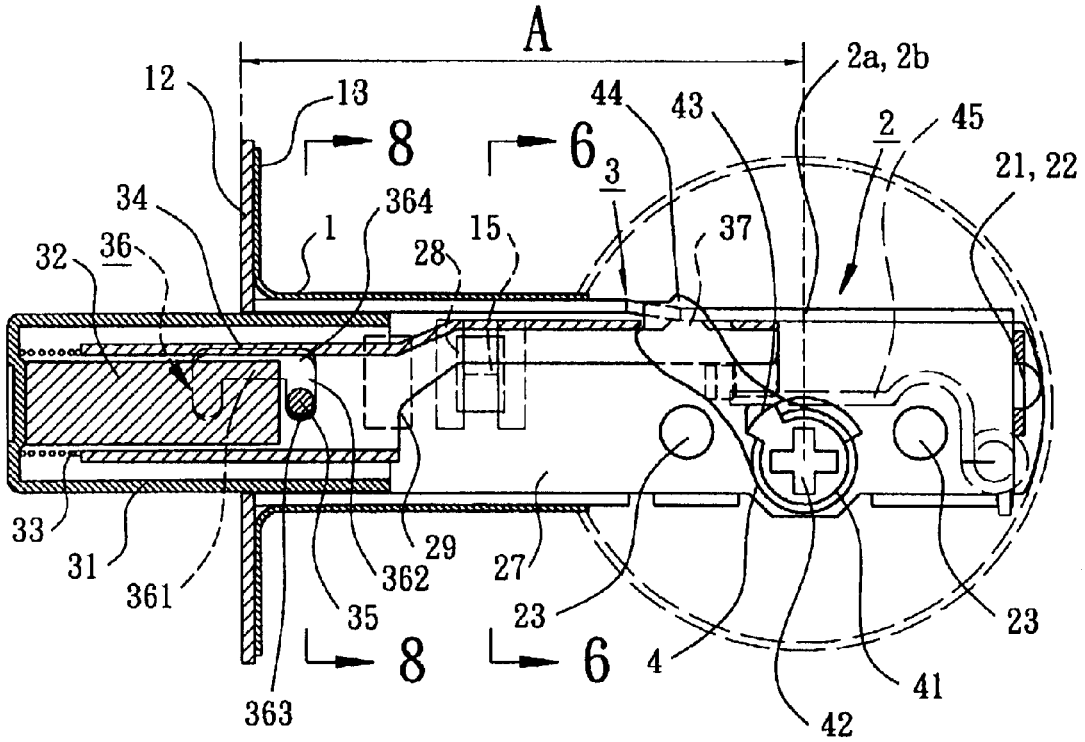
FIG. 5 is a sectional view taken along plane 5—5 in FIG. 3.
Figure 6:
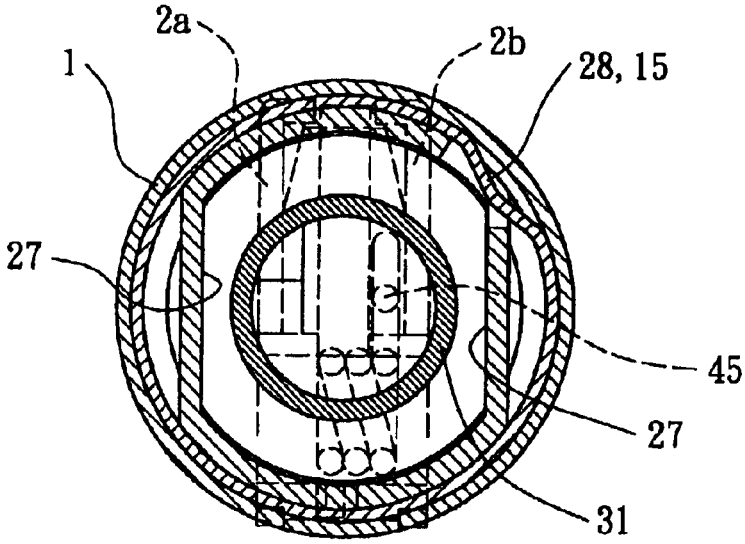
FIG. 6 is a sectional view taken along plane 6—6 in FIG. 5.

Referring to FIGS. 5 and 6, when the auxiliary lock is in the relatively smaller backset state, each end of the connecting member 35 is located in the inner end 363 of the associated retaining section 362 of the associated guide groove 36. Further, the guide member 15 of the housing 1 is located in the positioning slot 28.

Figure 7:
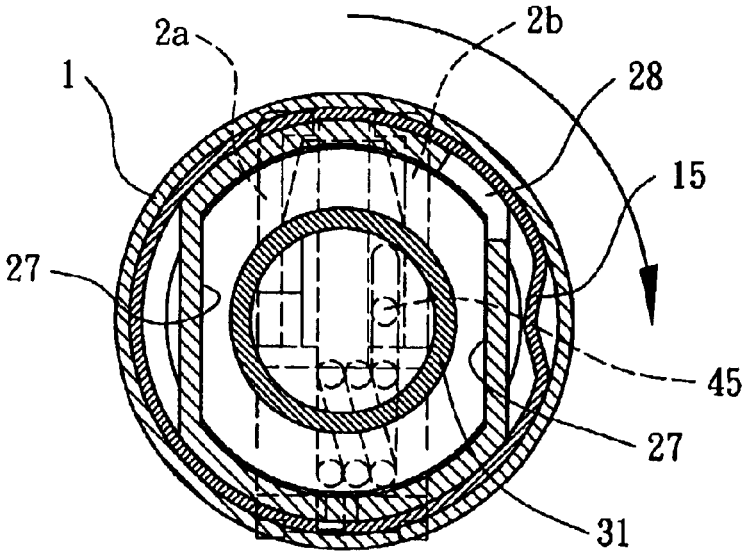
FIG. 7 is a sectional view similar to FIG. 6, wherein the housing is turned through an angle.
Figure 8:
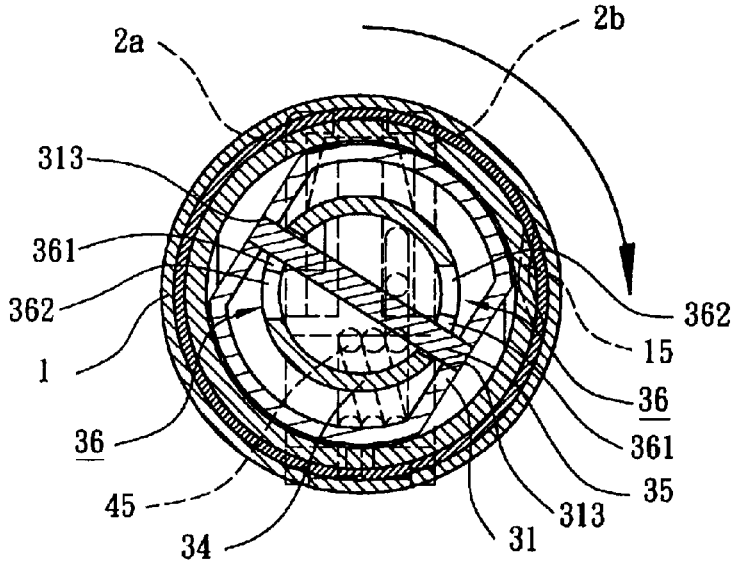
FIG. 8 is a sectional view taken along plane 8—8 in FIG. 5 with the housing being turned through an angle.
Figure 9:
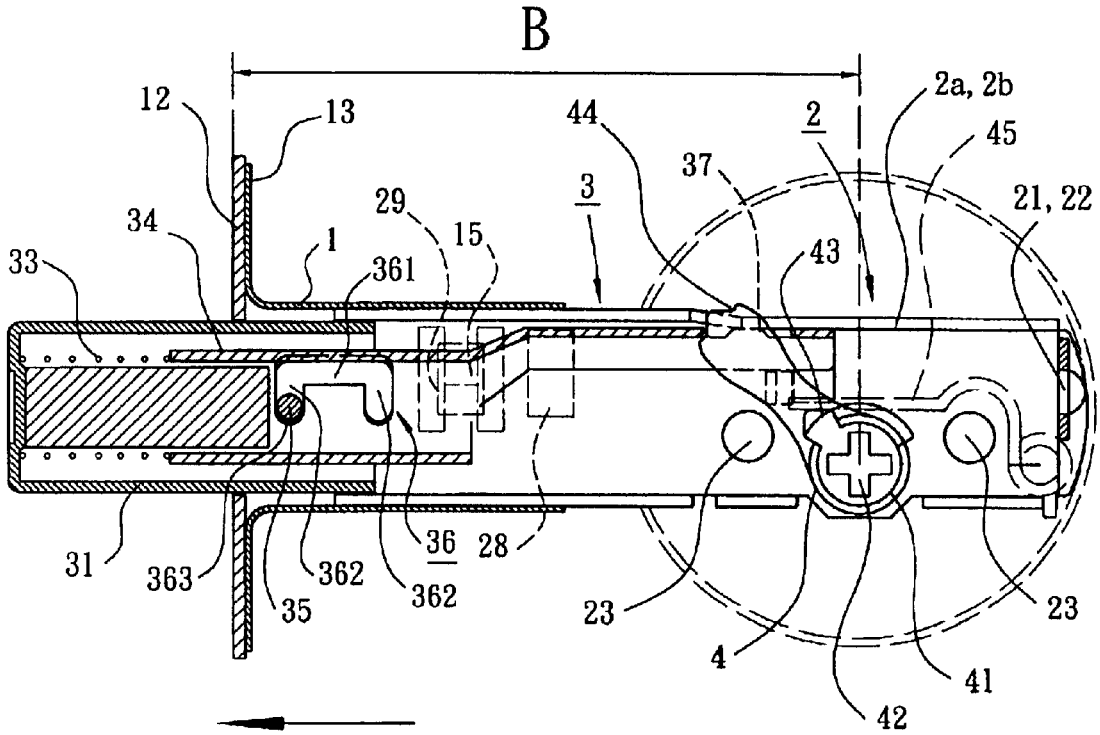
FIG. 9 is a sectional view similar to FIG. 5, wherein the auxiliary lock has a longer backset.
Figure 10:
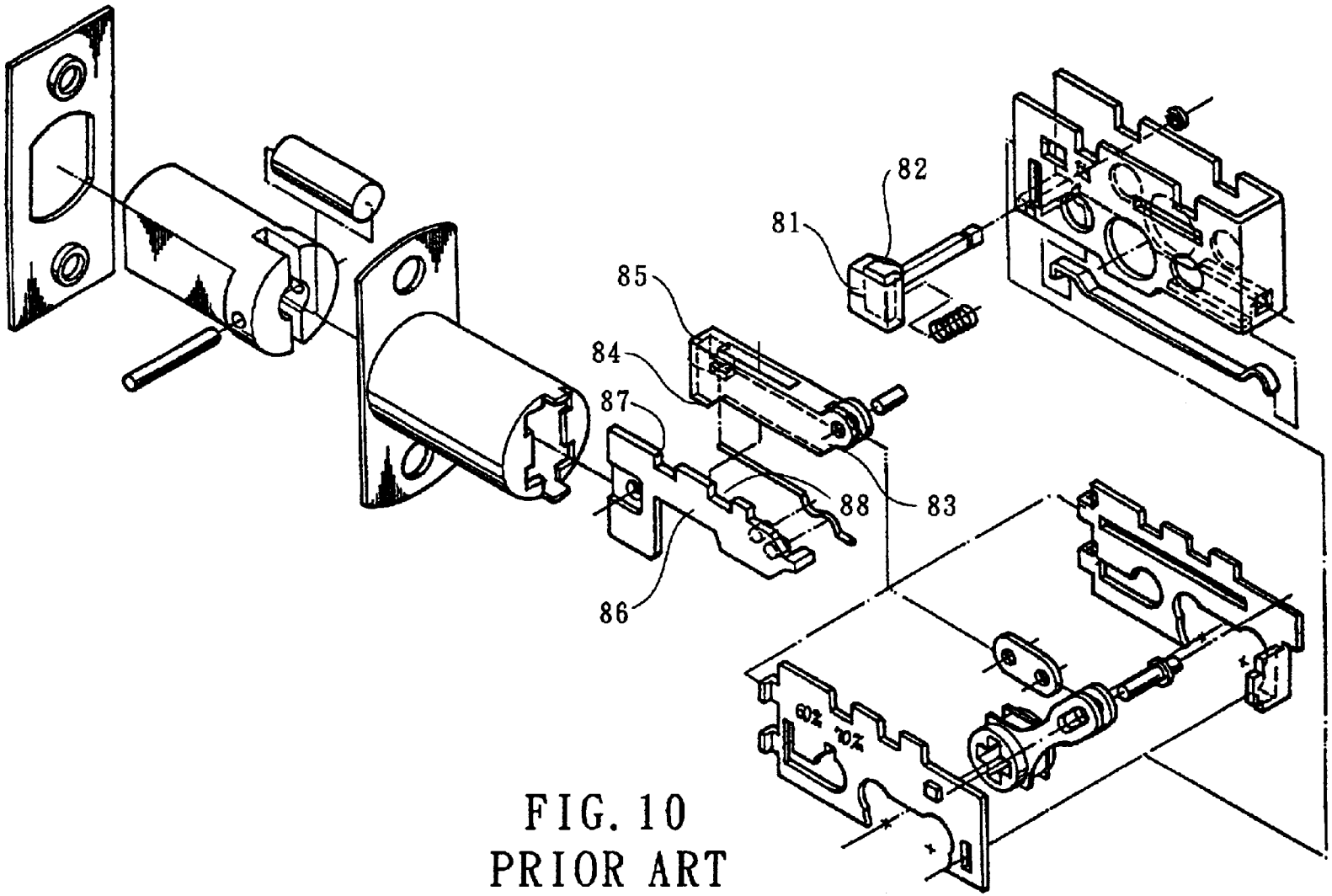
FIG. 10 PRIOR ART
FIG. 10 is an exploded perspective view of a conventional auxiliary lock with an adjustable backset.
Figure 11:
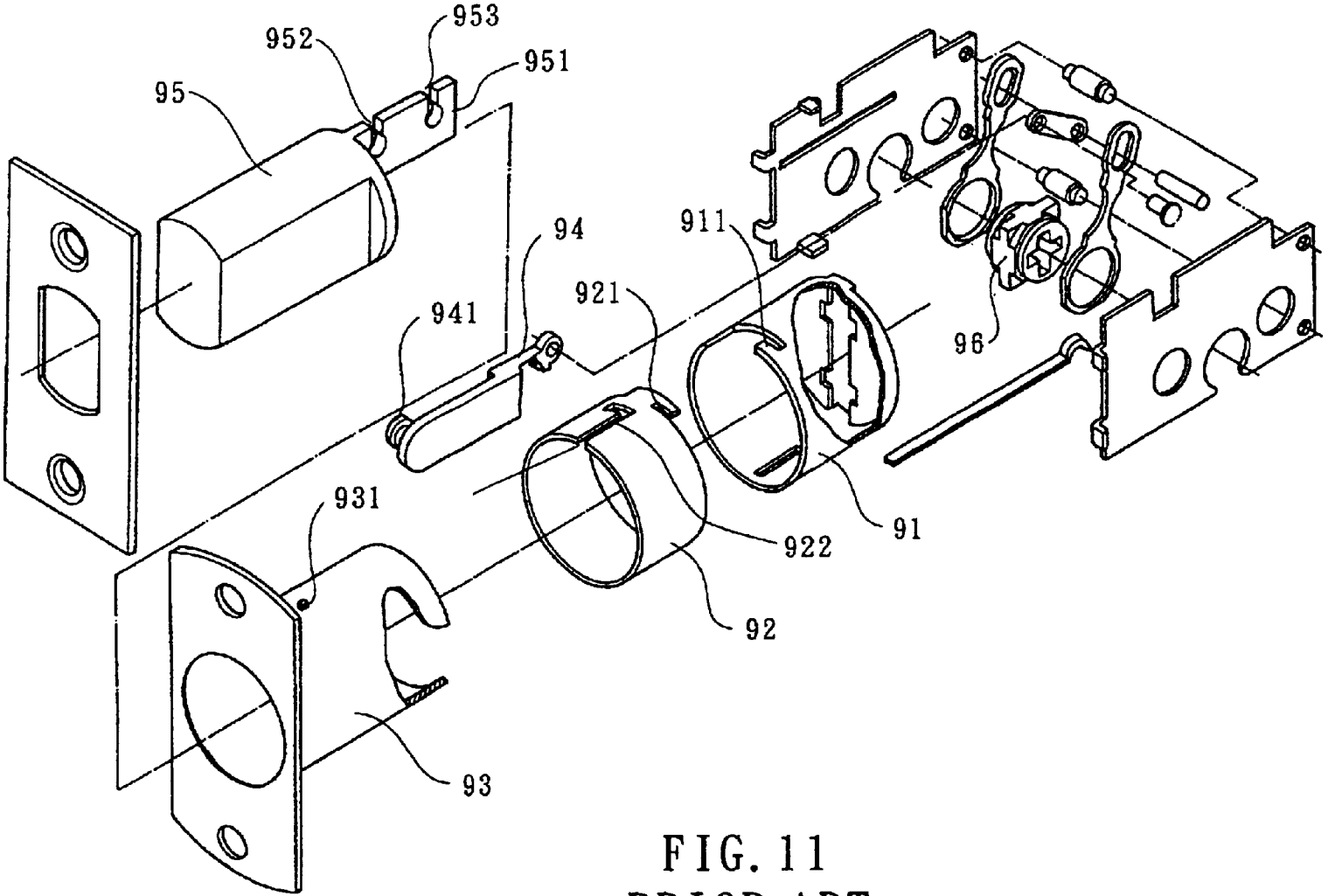
FIG. 11 PRIOR ART
FIG. 11 is an exploded perspective view of another conventional auxiliary lock with an adjustable backset.

Referring to FIG. 7, when adjustment of the backset is required, the deadbolt 31 is moved to its extended state shown in FIG. 5. Thus, the enlarged portion of the deadbolt 31 is disengaged from the non-circular hole portion 27 and moves into the circular hole portion 26 of the casing 2. Thus, the deadbolt 31 may turn together with the housing 1 relative to the casing 2. Next, the housing 1 is turned relative to the casing 2 along a direction indicated by an arrow in FIG. 7. It is noted that the deadbolt 31 is also turned. The guide member 15 is disengaged from the positioning slot 28 to thereby allow relative longitudinal movement of the housing 1 relative to the casing 2, and each end of the connecting member 35 is moved to the outer end 364 of the associated retaining section 362 of the associated guide groove 36 that is coincident with an end of the associated longitudinal section 361 of the associated guide groove 36, allowing longitudinal movement of the deadbolt 31 relative to the casing 2, as shown in FIG. 8. Then, the housing 1 is moved away from the other side of the casing 1 (see the arrow in FIG. 9) to a position shown in FIG. 9 under the action of the elastic element 33 when the user holds the casing 1 while the housing 1 is released. The ends of the connecting member 35 respectively slide along the longitudinal sections 361 of the grooves 36 to the other ends of the longitudinal sections 361. Next, the housing 1 is turned along a reverse direction such that the guide member 15 is engaged in the other positioning slot 29 of the casing 2, thereby preventing longitudinal movement of the housing 1 relative to the casing 2. The deadbolt 31 is also turned such that each end of the connecting member 35 is moved to the inner end 363 of the associated retaining section 362 of the other guide groove 36, preventing longitudinal movement of the deadbolt 31 relative to the casing 2. Thus, the auxiliary lock has a relatively larger backset (see the distance B between the center of the engaging hole 42 of the drive wheel 4 and the faceplate 12).

When the auxiliary lock is to be used with a door with a smaller backset (the distance between an end face of the door and a center of a mounting hole in the door), the auxiliary lock can be adjusted by reverse steps. It is noted that the adjusting procedure must begin with moving the deadbolt 31 to its extended state to allow joint rotation of the housing 1 and the deadbolt 31. Further, the user has to holds the casing 2 and push the housing 1 toward the other end of the casing 2 to overcome the elastic element 33.

According to the above description, it is appreciated that the auxiliary lock in accordance with the present invention is simpler when compared with the conventional auxiliary locks with backset-adjusting function. The reinforcing member 32 embedded in the deadbolt 31 improves the strength of the deadbolt 31. Further, since the casing 2 is mounted in the housing 1, the guide member 15 is engaged in one of the positioning slots 28 and 29, and the connecting member 35 is engaged in the retaining sections 362 of the guide grooves 36, the strength of the auxiliary lock is improved to thereby prevent damage to the auxiliary lock by means of applying a longitudinal force along the longitudinal section of the housing 1.

Although the invention has been explained in relation to its preferred embodiment as mentioned above, it is to be understood that many other possible modifications and variations can be made without departing from the scope of the invention. It is, therefore, contemplated that the appended claims will cover such modifications and variations that fall within the true scope of the invention.

What is claimed is:

1. An auxiliary lock comprising:

a housing including a circular hole therein, a faceplate being attached to an end of the housing and including an opening, the housing further including a guide member;

a casing including a first end and a second end, the first end of the casing being received within the housing and including a first positioning slot and a second positioning slot, the second end of the casing including aligned pivot holes, the guide member being selectively engaged in one of the first positioning slot and the second positioning slot, wherein the housing is movable along a longitudinal direction of the housing when the guide member is disengaged from the first and second positioning slots of the casing, and wherein the housing is not movable along the longitudinal direction of the housing when the guide member is engaged in one of the first positioning slot and the second positioning slot;

a deadbolt assembly including a deadbolt, a connecting member, and a pull rod, the deadbolt being received in the housing and slidable between a retracted position in the housing an extended position in which an end of the deadbolt is beyond the housing, the connecting member being mounted to another end of the deadbolt, the pull rod including a first end mounted in the deadbolt and a second end beyond the deadbolt, the first end of the pull rod including at least one guide groove having a longitudinal section and first and second retaining sections transverse to the longitudinal section and in communication with the longitudinal section adapted to confine movement of the pull rod between the first positioning slot and the second positioning slot which is engaged with the guide member and configured to prevent the pull rod from releasing from the deadbolt while the casing is adjusted in the housing, wherein when the connecting member is in one of the retaining sections, the deadbolt is not movable along the longitudinal direction of the housing, and wherein when the connecting member is in the longitudinal section, the deadbolt is movable along the longitudinal direction of the housing relative to the pull rod, the deadbolt and the opening of the faceplate being so configured that the deadbolt turns together with the housing when the deadbolt is in its extended position and that the deadbolt is not turnable when the deadbolt is in its retracted position;

a drive wheel including a cylindrical portion that is rotatably held in the pivot holes of the casing, a drive arm extending from the cylindrical portion and having an end connected to the second end of the pull rod such that rotation of the drive wheel causes movement of the pull rod for moving the deadbolt along the longitudinal direction of the housing; and an elastic element having a first end connected to the deadbolt and a second end connected to an end face of the pull rod so that the pull rod is automatically moved from a first backset position to a second backset position when the connecting member is released from the first retaining section of the pull rod, and the deadbolt must be forced to overcome a bias force of the elastic element for moving to a second backset distance when the connecting member is released from the second retaining section.

2. The auxiliary lock as claimed in claim 1, wherein the opening of the faceplate is not circular, the deadbolt including an enlarged portion to thereby form a stop edge for preventing disengagement of the deadbolt from the housing.

3. The auxiliary lock as claimed in claim 1, wherein an inner periphery defining each said pivot hole of the casing includes two angularly spaced restraining edges for restraining pivotal movement of the drive wheel.

4. The auxiliary lock as claimed in claim 1, wherein the deadbolt including a compartment, further including a rigid reinforcing member mounted in the compartment.

5. The auxiliary lock as claimed in claim 4, wherein the rigid reinforcing member is partially received in the pull rod.

6. The auxiliary lock as claimed in claim 1, wherein one of the guide grooves is U-shaped and the other guide groove is inverted U-shaped.

7. The auxiliary lock as claimed in claim 1, wherein the guide grooves are symmetrically defined in two opposite sides of the pull rod, and wherein the deadbolt includes aligned transverse holes in which two ends of the connecting member are received.

8. The auxiliary lock as claimed in claim 1, wherein the casing including a circular hole portion allowing rotation of the deadbolt, the casing further including a non-circular hole portion preventing rotation of the deadbolt yet allowing longitudinal movement of the deadbolt.

9. The auxiliary lock as claimed in claim 1, wherein the second end of the pull rod includes a hole in which the end of the drive arm is engaged.

10. The auxiliary lock as claimed in claim 1, wherein the drive wheel includes a stop, the casing further including an elastic element mounted therein, the elastic element having a first end attached to the stop of the drive wheel and a second end fixed to the casing.

11. The auxiliary lock as claimed in claim 1, wherein the casing is comprised of two casing halves.

12. The auxiliary lock as claimed in claim 1, wherein the guide groove has an enclosed periphery forming the longitudinal section and the retaining sections.

13. The auxiliary lock as claimed in claim 1, wherein the pull rod further includes a cylindrical portion provided with the guide groove so that the cylindrical portion is able to fittingly be inserted into a compartment of the deadbolt and the connecting member mounted therein is engageable with the guide groove.

* * * * *